United States Patent [19]

Knapp et al.

[11] Patent Number: 4,634,649

[45] Date of Patent: Jan. 6, 1987

[54] DEVELOPER COMPOSITIONS

[75] Inventors: John F. Knapp, Fairport; Robert J. Gruber, Pittsford, both of N.Y.

[73] Assignee: Xerox Corporation, Stamford, Conn.

[21] Appl. No.: 713,975

[22] Filed: Mar. 20, 1985

Related U.S. Application Data

[63] Continuation-in-part of Ser. No. 566,754, Dec. 27, 1983, which is a continuation-in-part of Ser. No. 219,674, Dec. 24, 1980, abandoned.

[51] Int. Cl.[4] ..... G03G 9/10

[52] U.S. Cl. ..... 430/109

[58] Field of Search ..... 430/109

[56] References Cited

U.S. PATENT DOCUMENTS

| | | | |
|---|---|---|---|
| 3,239,465 | 3/1958 | Rheinfrank | 252/62.1 |
| 3,558,492 | 1/1971 | Proskow | 252/62.54 |
| 3,645,770 | 2/1972 | Flint | 117/17.5 |
| 3,655,374 | 4/1972 | Palermiti et al. | 430/121 |
| 4,082,681 | 4/1978 | Takayama et al. | 252/62.1 P |

FOREIGN PATENT DOCUMENTS

| | | |
|---|---|---|
| 33248 | 8/1981 | European Pat. Off. . |
| 1373220 | 11/1974 | United Kingdom . |
| 1570239 | 6/1980 | United Kingdom . |
| 1578566 | 11/1980 | United Kingdom . |
| 1602427 | 11/1981 | United Kingdom . |

*Primary Examiner*—John D. Welsh
*Attorney, Agent, or Firm*—E. O. Palazzo

[57] ABSTRACT

Disclosed is a two-component developer composition enabling smudge resistant images which is comprised of improved two-component contamination free developer composition comprised of (1) magnetite; (2) a polyester resin comprised of the polymeric esterification product of a dicarboxylic acid and a diol comprising a diphenol of the following formula

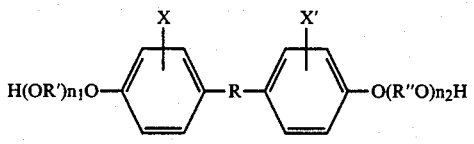

wherein R is selected from substituted and unsubstituted alkylene radicals of from about 2 to about 12 carbon atoms, alkylidene radicals of from 1 to 12 carbon atoms and cycloalkylidene radicals of from 3 to 12 carbon atoms; R' and R" are selected from substituted and unsubstituted alkylene radicals of from 2 to 12 carbon atoms, alkylene arylene radicals of from 8 to 12 carbon atoms and arylene radicals; X and X' are selected from hydrogen or any alkyl radical having from 1 to 4 carbon atoms; and each n is a number of from 0 (zero) to 4; and (3) carrier particles.

16 Claims, No Drawings

DEVELOPER COMPOSITIONS

BACKGROUND OF THE INVENTION

The present application is a continuation-in-part application of U.S. Ser. No. 566,754, filed on Dec. 27, 1983, entitled Improved Process for Preventing Deposition of Toner Particles in an Imaging Apparatus; which in turn was a continuation-in-part of U.S. Ser. No. 219,674, filed Dec. 24, 1980, entitled Contamination Free Toner and Process, which application has been abandoned. The disclosure of each of the aforementioned applications are totally incorporated herein by reference.

The present invention is generally directed to developer compositions, and more specifically to two-component developer compositions comprised of magnetic toner particles and carrier particles. In one embodiment the present invention is directed to developer compositions comprised of polyester resin particles, magnetite particles, additive particles of colloidal silicas and/or metal salts of fatty acids, and coated carrier particles. The developer compositions of the present invention are particularly useful in electrostatographic imaging processes, especially those processes wherein magnetic brush development is selected. When incorporating the developer compositions of the present invention into the aforementioned processes, there results smudge resistant images, that is, images with effective acceptable fixing, and further the developer compositions of the present invention prevent contamination of machine components, such as corotrons, present in the imaging apparatus. Also, the developer compositions of the present invention possess excellent charging or admixing characteristics when colloidal silicas are incorporated therein.

Developer compositions, including magnetic compositions, are known. There is thus disclosed in U.S. Pat. No. 3,345,294 a developer composition comprised of specific ingredients including, for example a resin, a major portion of which is a polyamide substance having a sharp melting point within the range of from about 70 degrees Centigrade to about 165 degrees centigrade. As disclosed in column 4, beginning at line 34 of this patent, a small amount of finely divided magnetic substance is added to the developer particles in order to reduce the tendency of the developer power or toner to adhere to the background of the resulting print. Examples of magnetic substances recited in this patent include magnetic iron oxides, ferrosoferric oxide powders, a magnetic metal substance, or an alloy. The magnetic material is generally present in an amount of between 5 percent and 25 percent by weight, reference the disclosure in column 4, beginning at line 38, of the '294 patent.

Additionally, there is disclosed in U.S. Pat. No. 4,082,681, a magnetic developer for xerographic imaging systems comprised of a magnetic material dispersed in a resinous binder, with finely divided solid conducting substances such as conductive carbon black particles. This patent is representative of several patents disclosing the use of magnetic materials in developer compositions. Moreover, there is disclosed in U.S. Pat. No. 4,288,519 a specific dual purpose single component conductive magnetically attractive toner containing a mixture of a thermoplastic resin, finely divided magnetic pigments, and anchored conductive pigments, wherein as a resinous substance there can be selected a linear polyester consisting of the condensation product of an aromatic diol with an unsaturated aliphatic dibasic acid having a softening point of from about 95 degrees centigrade to about 150 degrees centigrade, and an ethylene-vinylacetate copolymer. Furthermore, the use of polyester resins as toner components are disclosed generally in U.S. Pat. No. 3,590,000, the disclosure of which is totally incorporated herein by reference.

Moreover, disclosed in U.S. Pat. No. 3,239,465 are two-component developer compositions comprised of specific resin particles and magnetite. According to the disclosure of this patent, reference column 9, beginning at line 56, examples of suitable electroscopic materials selected for the developer composition include phenolformaldehyde resins, rosin modified phenolformaldehyde resins, maleic glyceride resins, polystyrene and butadiene styrene copolymers, and other substances. There is incorporated into the toner of the '465 patent magnetic substances inclusive of magnetites in amounts, for example, of from about 20 percent to about 70 percent, reference the disclosure in column 10, beginning at line 41. Examples of granular carrier particles that may be selected are outlined in column 12, beginning at line 18, of the '465 patent. One problem associated with the two-component developer compositions of the '465 patent, which problem is solved with the developer composition of the present invention, is that, for example, the developed images resulting possess inadequate fixing characteristics causing undesirable smudging of the images; and further many of these developer compositions have inferior charging characteristics when compared to specific developers of the present invention.

While the prior art toner compositions are sufficient for their intended uses, many of these compositions have a tendency to contaminate the components present in the xerographic imaging apparatus. With these compositions, the toner particles tend to separate from the carrier particles prior to, for example, contacting the latent image on the photoconductive member. The separated toner particles are then free to deposit on machine components, and thus contaminate the machine environment, thereby resulting in developed images of low resolution or no developed images whatsoever; and causing possible enviromental problems. Further, the deposition of the toner particles renders it necessary over a period of time to replace or clean the internal machine components which adds to the cost of maintenance. For example, when unused toner particles deposit on the optical systems present in electrophotographic machines, a latent image corresponding to the original to be copied will not be fully formed, if formed at all, on the photoreceptor surface thereby resulting in a final fused image of very low quality, which in some instances may be unreadable depending on the amount of toner particles deposited. Additionally, in some instances, the resulting images are not completely fixed to the final substrate causing undesirable smudging. Contamination and smudging is eliminated with the composition of the present invention primarily since the toner particles are prevented from separating from the carrier particles prior to, for example, contacting the latent image, which toner particles separate therefrom as a result of collisions between the toner particles and carrier particles contained in the developer composition with the components of the electrophotographic imaging apparatus.

Accordingly, there is a need for developer compositions that prevent the contamination of internal machine components with toner particles. Additionally, there continues to be a need for developer compositions which substantially eliminate dust and allow the toner particles to remain attached to the carrier particles subsequent to collisions with components in the electrophotographic apparatus. Moreover, there continues to be a need for developer compositions that will prevent toner particles from depositing on components in the electrostatographic imaging apparatus, including, for example, the developer housing apparatus, charging devices, such as corona wires, optical parts, lamps, and the like, which deposition adversely affects the operation of the imaging apparatus and causes poor image quality. Furthermore, there is a need for improved compositions that prevent the contamination of xerographic imaging apparatus, enables images that are smudge resistant, provide adequate fixing characteristics, and excellent charging properties.

SUMMARY OF THE INVENTION

It is an object of the present invention to provide developer compositions which overcome many of the above-noted disadvantages.

In another object of the present invention there are provided two-component magnetic developer compositions which enable the development and formation of images which are smudge resistant.

Yet a further important object of the present invention is the provision of an improved magnetic developer wherein the toner particles are caused to adhere to the carrier particles, thus substantially eliminating the migration or movement of these particles in electrostatographic apparatuses.

A further object of the present invention resides in the provision of developer compositions that prevent the unwanted deposition or contamination of toner particles on machine components. With the developer composition of the present invention, the toner material is not free to contaminate machine components thereby prolonging the life thereof; and further these compositions permit the formation and development of images of high quality while simultaneously eliminating costly maintenance upkeep. .

In a further object of the present invention there are provided developer compositions comprised of polyester resins, magnetite substances, additive particles, and carrier particles, which compositions can be adequately fixed to substrates and enable smudge resistant images to be obtained.

In yet another object of the present invention there are provided developer compositions with excellent charging characteristics.

These and other objects of the present invention are accomplished by the provision of a two-component developer composition comprised of a polyester resin as defined hereinafter, a magnetic component, optional additive particles, and carrier particles. With these developer compositions there is obtained images of high quality which are resistant to smudging; and further these compositions simultaneously eliminate machine contamination as the toner particles are prevented from depositing on components therein. This contrasts with many prior art compositions wherein the toner particles separate from the carrier particles as a result of collisions between these particles, and the components of the imaging apparatus. Therefore, when the carrier and toner particles collide with a baffle component in the imaging apparatus, the toner particles will separate as a result of the force involved, that is the force of collision with the imaging components overcomes the binding force existing between the toner and carrier particles, causing the carrier particles to become detached from the toner particles. The resulting free toner particles are then caused to move within the system and after a period of time deposit on various components of the imaging apparatus causing contamination thereof. This contamination adversely effects image quality wherein in many instances images of low resolution result. Additionally, with some of the prior art developer compositions there are provided images that are not resistant to smudging, that is they are not adequately fixed.

Polyester resins selected for the developer composition of the present invention are comprised of the polymeric esterification product of a dicarboxylic acid and a diol comprising a diphenol of the following formula:

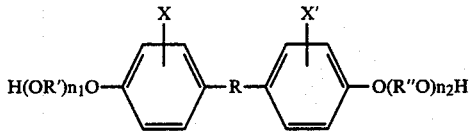

wherein R is selected from substituted and unsubstituted alkylene radicals having from about 2 to about 12 carbon atoms, alkylidene radicals having from 1 to 12 carbon atoms and cycloalkylidene radicals having from 3 to 12 carbon atoms; R' and R" are selected from substituted and unsubstituted alkylene radicals having from 2 to 12 carbon atoms, alkylene arylene radicals having from 8 to 12 carbon atoms and arylene radicals; X and X' are selected from hydrogen or an alkyl radical having from 1 to 4 carbon atoms; and each n is a number of from 0 (zero) to 4. Diphenols wherein R represents an alkylidene radical having from 2 to 4 carbon atoms, and R' and R" represents an alkylene radical having from 3 to 4 carbon atoms are preferred as greater blocking resistance, increased definition of xerographic characters, and more complete transfer of the toner images are achieved. Optimum results are obtained with diols in which R is an isopropylidene radical and R' and R" are selected from the group consisting of propylene and butylene radicals and n is 1 (one), as the resins formed from these diols possess higher agglomeration resistance and penetrate extremely rapidly into paper receiving sheets.

Typical diphenols with the foregoing general formula include: 2,2-bis(4-beta hydroxy ethoxy phenyl)-propane, 2,2-bis(4-hydroxy isopropoxy phenyl)propane, 2,2-bis(4-beta hydroxy ethoxy phenyl)petane, 2,2-bis(4-beta hydroxy ethoxy phenyl)-butane, 2,2-bis(4-hydroxy-propoxy-phenyl)-butane, 2,2-bis(4-hydroxy-propoxy-phenyl)propane, 1,1-bis(4-hydroxy-ethoxy-phenyl)butane, 1,1-bis(4-hydroxy isopropoxy-phenyl)-heptane, 2,2-bis(3-methyl-4-beta hydroxy ethoxy-phenyl)propane, 1,1-bis(4-beta hydroxy ethoxy phenyl)-cyclohexane, 2,2'-bis(4-beta hydroxy ethoxy phenyl)-norbornane, 2,2'-bis(4-beta hydroxy ethoxy phenyl)norbornane, 2,2-bis(4-beta hydroxy styryl oxyphenyl)propane, the polyoxy-ethylene ether of isopropylidene diphenol in which both phenolic hydroxyl groups are oxyethylated and the average number of oxyethylene groups per mole is 2.6, the polyoxypropylene ether of 2-butylidene diphenol, in which both the phenolic hydroxyl groups are oxyalkylated and the average number of oxypropylene groups per mole is 2.5; and the like.

Suitable dicarboxylic acids that may be reacted with the diols described to form the toner resins of this invention, which acids may be substituted, unsubstituted, saturated or unsaturated, include those of the general formula:

$$HOOCR'''_{n_3}COOH$$

wherein R''' is a substituted or unsubstituted alkylene radical having from 1 to 12 carbon atoms, arylene radicals or alkylene arylene radicals having from 10 to 12 carbon atoms and $n_3$ is a number of less than 2. By dicarboxylic acid it is intended to include the known anhydrides of such acids. Typical dicarboxylic acids are: oxalic acid, malonic acid, succinic acid, glutaric acid, adipic acid, pimelic acid, suberic acid, azelaic acid, sebacic acid, phthalic acid, mexaconic acid, homophthalic acid, isophthalic acid, terephthalic acid, o-phenyleneacetic-beta-propionic acid, itaconic acid maleic acid, maleic acid anhydrides, fumaric acid phthalic acid anhydride, traumatic acid, citraconic acid, and the like. Dicarboxylic acids having from 3 to 5 carbon atoms are preferred as the resulting toner resins possess greater resistance to film formation on reusable imaging surfaces. Optimum results are obtained with alpha unsaturated dicarboxylic acids, such as fumaric acid, maleic acid, or maleic acid anhydride as maximum resistance to physical degradation of the toner as well as rapid melting properties are achieved. Although it is not entirely clear, it is believed that the presence of the unsaturated bonds in the alpha unsaturated dicarboxylic acid reactants provide the resin molecules with a degree of toughness, without adversely affecting the fusing and comminution characteristics.

The preferred polyester material of the present invention is comprised of the reaction product of 2,2-bis(4-hydroxy isopropoxy phenyl)propane and fumaric acid, as such a polyester when used as the toner resin results in images of very high resolution and superior quality.

Illustrative examples of magnetic materials or fillers that may be selected for the composition of the present invention include, for example, magnetites such as $Fe_2O_3$, $Fe_3O_4$, Mapico Black, a commercially available material, MO-4232, a magnetite commercially available from Pfizer Pigment Company, New York, N.Y., K-378, a magnetite commercially available from Northern Pigments Corporation, Toronto, Ontario, Canada, and mixtures thereof. Mapico Black is preferred in that the particles are black in color, of low cost, and provide excellent magnetic properties.

The amount of magnetic pigment selected in one preferred embodiment is from about 20 to about 30 percent by weight, however, the amount of magnetic pigment present can be of from about 15 percent to about 50 percent by weight. Also, the amount of polyester material present is from about 50 percent to about 85 percent by weight, and preferably from about 70 to about 80 percent by weight. With the preferred amount of magnetic pigment, fewer toner particles separate from the carrier particles.

External additives added as optional ingredients to the developer composition of the present invention include colloidal silicas, such as Aerosil, metal salts, metal salts of fatty acids, such as zinc stearate, mixtures thereof and the like, reference U.S. Pat. No. 3,983,045, the disclosure of which is totally incorporated herein by reference; and U.S. Pat. No. 3,320,169, the disclosure of which is totally incorporated herein by reference. The Aerosil materials function primarily as a charging source, and are preferably present when negatively charged toner compositions are desired, while the salts which function as lubricating agents are preferably selected with blade cleaning systems. From about 0.2 percent to about 0.8 percent based on the weight of the toner ingredients, and preferably from about 0.5 percent to about 0.8 percent of the colloidal silicas are selected for incorporation into the toner composition. The external salt additives are present in an amount of from about 0.10 percent to about 0.6 percent, and preferably from about 0.3 percent to 0.5 percent. Percentages outside these ranges may be useful providing the objectives of the present invention are achievable.

As other additive components, there may be included in the developer composition of the invention pigments such as carbon black, including Black Pearls L, REGAL ®330, VULCAN ®, mixtures thereof, and the like. The carbon black is usually present in an amount of from about 1 percent to about 10 percent by weight, and preferably in an amount of from about 2 percent to about 5 percent by weight, based on the weight of the toner components. The aforementioned pigments are preferably present in those instances where less than 20 percent by weight of magnetite is selected.

Typical carrier materials that can be used for forming the developing composition of the present invention include those that are capable of triboelectrically obtaining a charge of opposite polarity to that of the toner particles. Examples of carriers include potassium chloride, Rochelle salt, sodium nitrate, aluminum nitrte, potassium chlorate, granular zircon, granular silicon, methyl methacrylate, glass, steel, nickel, iron ferrites, silicon dioxide and the like. Preferably, the carrier particles selected contain coatings thereover inclusive of polymethyl methacrylates; terpolymers of styrene, methacrylate, and vinyl triethoxy silane, reference U.S. Pat. No. 3,526,533, the disclosure of which is totally incorporated herein by reference; and other similar equivalent coatings. Also, nickel berry carriers as illustrated in U.S. Pat. Nos. 3,847,604 and 3,767,598, the disclosures of which are incorporated herein by reference, may be useful. These carriers are comprised of nodular beads of nickel with surfaces of reoccurring recesses and protrusions providing particles with a relatively large external area. The diameter of the coated carrier particles is from about 50 to about 500 microns thus allowing the carrier to present sufficient density and inertia to avoid adherence to the electrostatic images during the development process. The preferred carrier is comprised of a steel core coated with a polymethyl methacrylate resin, or the terpolymer resins of U.S. Pat. Nos. 3,526,533 and 3,467,634, the disclosures of which are totally incorporated herein by reference.

The carrier may be mixed with the toner composition in various effective suitable compositions, however, best results are obtained when there is used from about 0.5 parts to about 10 parts of toner to 100 to 200 parts by weight of carrier, and preferably from about 3 parts of toner to 100 parts by weight of carrier.

The compositions of the present invention may be selected for the development of images in an electrostatographic apparatus, having preferably incorporated therein various different inorganic photoreceptors including amorphous selenium, selenium alloys, such as selenium antimony, selenium tellurium, selenium antimony tellurium, selenium tellurium, selenium antimony tellurium, and selenium arsenic. Examples of organic photoreceptors that may be selected are polyvinyl carbazole, 4-dimethylamino benzylidene, benzhydrazide, 2-benzylidene-amino-carbazole, polyvinylcarbazole, para bromo aniline, 2,4-diphenyl quinazoline, 1,2,4-triazine, 1,5-diphenyl 3-methyl pyrazoline 2-(4'-dimethylamino phenyl)-benzoxazole, 3-amino carbazole, and polyvinyl-carbazole-trinitrofluorenone charge transfer complexes. Also, layered photoreceptors, including those described in U.S. Pat. No. 4,265,990, the disclosure of which is totally incorporated herein by reference, may be selected providing the toner composition is positively charged with, for example, charge enhancing additives such as cetyl pyridinium chloride.

Numerous different known methods can be utilized for preparing the toner and developers of the present invention including spray drying, jetting, and the like; however, one preferred method of preparation involves hot melt formation and mastication of the toner resin, and magnetite, using a Bambury rubber mill process, followed by attrition to obtain toner particle sizes of less than 25 microns on the average, reference U.S. Pat. No. 4,293,627, the disclosure of which is totally incorporated herein by reference.

When using the developer of the present invention in electrostatographic imaging processes, substantially no contamination of the machine components resulted, or the contamination was so slight so as to not adversely affect the quality of the images generated. This was demonstrated, for example, by comparing the amount of toner that was deposited on a machine component when using the toner of the present invention with prior art toner compositions, as detailed herein. Therefore, the compositions of the present invention are very useful in xerographic or magnetic imaging processes. In these processes, the developer composition of the present invention is selected for rendering the images visible, followed by image transfer to a suitable substrate and thereafter permanently affixing the image thereto. Specifically, in xerographic processes with the developer of the present invention, images of exceptional quality were continuously generated over extended time periods with substantially no unwanted toner deposition resulting on machine components as described in more detail hereinafter.

The invention will now be described in detail with respect to specific preferred embodiments thereof, it being understood that these examples are intended to be illustrative only and the invention is not intended to be limited to the materials, conditions, process parameters, and the like recited herein. All parts and percentages are by weight unless otherwise indicated.

EXAMPLE I

There was prepared by melt mixing followed by mechanical attrition a toner composition containing 50 percent by weight of the polyester resin which is the reaction product of 2,2-bis(4-hydroxy isopropoxy phenol)propane and fumaric acid, and is commercially available from ICI Corporation; 50 percent by weight of the magnetic iron oxide commercially available as Mapico Black; and as external additives (not part of the resin blend) 0.65 percent by weight of Aerosil R972, and 0.35 percent by weight of zinc stearate.

Three parts by weight of the above toner composition together with 100 parts by weight of carrier particles comprised of steel cores coated with a polymethyl methacrylate resin were admixed together resulting in a two-component developer composition, which when used in the xerographic imaging apparatus, commercially available as the Xerox Corporation 3300®, with magnetic brush development generated high quality copies of exceptional resolution, substantially no background, for about 25,000 imaging cycles. Inspection of the 3300® machine components, including the optical system, reveals substantially no deposition of toner particles, or other contamination.

EXAMPLE II

A developer composition was prepared by repeating the procedure of Example I with the exception that there was selected as the toner composition 75 percent by weight of the polyester resin, 20 percent by weight of the magnetite Mapico Black, 0.65 percent Aerosil, 0.35 percent of zinc stearate, and 5 percent by weight of carbon black, Black Pearls L. Substantially similar results were observed in the 3300®.

EXAMPLE III

A developer composition was prepared by repeating the procedure of Example II with the exception that there was used in place of Black Pearls L, 5 percent by weight of the carbon black REGAL®330. Substantially similar results were observed in the 3300®.

EXAMPLE IV

A developer composition was prepared by repeating the procedure of Example I with the exception that there was selected 70 percent by weight of the polyester resin, 20 percent by weight of Mapico Black, 5 percent by weight of Black Pearls L and 5 percent by weight of Nigrosine; and substantially similar results were observed in the 3300®.

EXAMPLE V

A developer composition was prepared by repeating the procedure of Example I with the exception that there was selected 75 percent by weight of the polyester resin, and 25 percent by weight of Mapico Black. When this developer composition, three parts by weight, was mixed with 100 parts by weight of the carrier of Example I there was obtained exceptional prints of high quality after 7,500 imaging cycles in the Xerox Corporation 3300® apparatus. Additionally, it was observed that substantially no contamination resulted on any of the machine components of the 3300®, including the optical system, as compared to substantial contamination when a developer composition comprised of 90 percent by weight of the same polyester resin, 10 percent by weight of Black Pearls L carbon black; and the additives and the carrier of Example I were selected.

EXAMPLE VI

A developer composition is prepared by repeating the procedure of Example I with the exception that the composition contains 72 percent by weight of the polyester resin, 20 percent by weight of Mapico Black, 6 percent by weight of the carbon black REGAL®330, and 2 percent by weight of the charge control additive cetyl pyridinium chloride, and a carrier consisting of steel, powder coated with 0.175 percent of polyvinylidene fluoride (KYNAR®). Substantially similar results are obtained when this developer composition is used in a xerographic imaging test fixture, wherein the imaging member is comprised of a photogenerating layer of trigonal selenium dispersed in polyvinylcarbazole, and a charge transport layer of N,N'-diphenyl-N,N'-bis(3-methylphenyl) 1,1'-biphenyl-4,4'-diamine dispersed in a polycarbonate, reference U.S. Pat. No. 4,265,990.

There was selected as a developer composition for use in a xerographic imaging apparatus with magnetic brush development, commercially available from Xerox Corporation as the 3300® machine, the carrier of Example I, and a toner which consisted of 75 percent by weight of the polyester resin of Example I, (reaction product of 2,2-bis(4-hydroxy isopropoxy phenyl)propane and fumaric acid), 25 percent of Mapico Black, a commercially available magnetic iron oxide, 0.65 percent of Aerosil R972, and 0.35 percent of zinc stearate. Toner particles or dirt were not observed on the corotron, after 2,500 imaging cycles; as compared to the observation of substantial amounts of "dirt" or toner particles, after 2,500 imaging cycles, when the same developer was selected without Mapico Black for use in the 3300® machine. Specifically, about 25 percent of the corotron contained unwanted toner particles when no Mapico Black was used in the developer composition.

Also, images of very low quality, which images contained substantial areas of unwanted background deposits were obtained in the 3300® machine after 2,500 copies with the developer composition without Mapico Black in view of the deposition of the toner particles on the corotron, while images of high quality with no background deposits were obtained in the 3300® machine after 2,500 copies with the developer composition containing Mapico Black.

Substantially similar results were observed when the above toner compositions were used in a 3300® machine, in that a baffle on the development housing contained substantial amounts of unwanted toner particles, about 75 percent of the baffle being covered, when no Mapico Black was present; as compared to no "dirt" or toner particles on the same baffle in the 3300® machine when Mapico Black was present in the toner.

Further experiments indicated the deposition of 60 particles per square millimeter per second on a filter device with the above developer composition containing no Mapico Black, as compared to the deposition of 6 particles per square millimeter per second on the same filter device with the above developer composition, containing Mapico Black.

EXAMPLE VII

There was prepared by repeating the procedure of Example I, a toner composition with one of the resins as disclosed in U.S. Pat. No. 3,239,465. More specifically, there was prepared by melt blending followed by mechanical attrition, a toner composition containing 74 percent by weight of a polystyrene resin, commercially available as 666U from Dow Chemical Corporation, 20 percent by weight of Mapico Black, a magnetite commercially available, and 6 percent by weight of carbon black. Subsequently, a developer composition was prepared by preblending the above toner composition, 1.5 percent toner concentration, (1.5 parts of toner per 100 parts by weight of carrier) with carrier particles containing a steel core, coated with 0.4 percent by weight of a polymethacrylate resin, the carrier particles having a diameter of 100 microns.

This composition was then selected for developing images in a xerographic imaging apparatus with magnetic brush development, which apparatus is commercially available from Xerox Corporation as the 2600®. During development, the process speed of the machine was established at 2 inches per second, and the copy rate was 12 copies per minute. The fusing unit contained in this apparatus was a radiant type device with an additional base unit, the input power to the radiant quartz lamp contained in the machine being 850 watts. The base was set at a temperature of 225 degrees centigrade. Also, the temperature was maintained at 250 degrees, and the radiant lamp was caused to flash when copies pass through the fusing station present in the machine.

After about 1,000 copy cycles, and subsequent to fusing, the resulted images did not fix properly, could be easily erased, and were not smudge resistant. Similar results were obtained when these were added to the above toner, 0.65 percent of Aerosil R972, and 0.35 percent of zinc stearate.

In contrast with the developer composition of the present invention there resulted images that were smear resistant. There was thus prepared a toner composition containing 74 percent by weight of the polyester prepared from 2,2'-bis(4-hydroxy isopropoxy phenyl)propane and fumaric acid, 20 percent by weight of Mapico Black, commercially available, 0.65 percent Aerosil R972, 0.35 percent of zinc stearate, and 6 percent by weight of carbon black, by melt blending these ingredients followed by mechanical attrition.

Subsequently, a developer composition was prepared by preblending the above toner composition, 1.5 percent toner concentration, (1.5 parts by weight of toner per 100 parts by weight of carrier), with a carrier containing a steel core, and 0.4 percent by weight of a coating of polymethylmethacrylate polymer. The carrier particles were of a diameter of 100 microns. This developer composition was then incorporated into the same 2600® machine described above and after 1,000 copies, and subsequent to fusing, there resulted images which could not be easily erased, and were smudge resistant. These images were essentially smudge proof as evidenced by a visual observation, and further a finger rubbing of these images did not result in smearing thereof.

Developer compositions were also prepred in accordance with Example I with the exception that the carrier coating selected was comprised of a terpolymer of styrene, methylmethacrylate, and vinyl triethoxy silane. There resulted substantially similar smudge resistant images that were adequately fused, with no machine contamination occurring for 25,000 imaging cycles in the 3100®.

Other modifications of the present invention will occur to those skilled in the art upon a reading of the present disclosure. These are intended to be included within the scope of this invention.

What is claimed is:

1. An improved two-component contamination free developer composition of: a toner having magnetite and a polyester resin comprised of the polymeric esterification product of a dicarboxylic acid or anhydride selected from the group consisting of fumaric and maleic, and a diol comprising a diphenol of the following formula

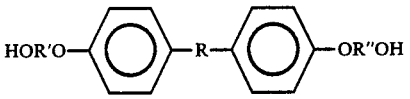

wherein R, R′ and R″ are the same or different and each is selected from substituted or unsubstituted lower alkyl radicals; and carrier particles; said magnetite being about 15 to about 50 percent, and said polyester resin being about 50 to about 85 percent, by weight of the toner.

2. An improved developer composition in accordance with claim 1 wherein the magnetite is present in an amount of from about 20 percent by weight to about 50 percent by weight, and the polyester resin is present in an amount of from about 50 percent by weight to about 80 percent by weight.

3. A developer composition in accordance with claim 1 wherein the polyester is obtained from the reaction of 2,2-bis(4-hydroxyisopropoxy phenyl)propane and fumaric acid.

4. A developer composition in accordance with claim 1 further including additive particles.

5. A developer composition in accordance with claim 4 wherein the additive particles are selected from the group consisting of colloidal silicas, metal salts, and metal salts of a fatty acid.

6. A developer composition in accordance with claim 5 wherein the fatty acid metal salt is zinc stearate.

7. A developer composition in accordance with claim 5 wherein the colloidal silica additive particles are present in an amount of from about 0.2 percent by weight to about 0.8 percent by weight of the toner.

8. A developer composition in accordance with claim 5 wherein the metal salt fatty acid additive particles are present in an amount of from about 0.1 percent by weight to about 0.6 percent by weight of the toner.

9. A developer composition in accordance with claim 5 wherein the colloidal silica is present in an amount of 0.65 percent by weight, and the metal salt of fatty acid is present in an amount of 0.35 percent by weight of the toner.

10. A developer composition in accordance with claim 1 wherein the carrier particles contain a coating thereover.

11. A developer composition in accordance with claim 10 wherein the coating is selected from the group consisting of polymethylmethacrylates, and terpolymers of styrene, methacrylate, and a vinyl triethoxy silane.

12. A developer composition in accordance with claim 1 further including pigment particles in the toner.

13. A developer composition in accordance with claim 12 wherein the pigment particles are carbon black.

14. A developer composition in accordance with claim 12 wherein there is further included additive particles selected from the group consisting of colloidal silicas, metal salts, and metal salts of a fatty acid.

15. A developer composition in accordance with claim 14 wherein the fatty acid metal salt is zinc stearate.

16. A developer composition in accordance with claim 10 wherein the carrier core is steel.

* * * * *